US006508638B2

(12) United States Patent
Sagar

(10) Patent No.: US 6,508,638 B2
(45) **Date of Patent: *Jan. 21, 2003**

(54) DUAL STAGE COMPRESSOR

(76) Inventor: Christopher L. Sagar, 7534 42nd Ct. East, Sarasota, FL (US) 34324

( * ) Notice: Subject to any disclaimer, the term of this patent is extended or adjusted under 35 U.S.C. 154(b) by 0 days.

This patent is subject to a terminal disclaimer.

(21) Appl. No.: 10/074,525

(22) Filed: Feb. 11, 2002

(65) Prior Publication Data

US 2002/0071777 A1 Jun. 13, 2002

Related U.S. Application Data

(63) Continuation of application No. 09/519,651, filed on Mar. 6, 2000, now Pat. No. 6,345,965.

(51) Int. Cl.[7] ..... F04B 37/10
(52) U.S. Cl. ..... 417/569; 417/559
(58) Field of Search ..... 417/569, 559, 417/410.1, 414, 415, 557, 560

(56) References Cited

U.S. PATENT DOCUMENTS 6,345,965 B1 * 2/2002 Sagar ..... 417/559

* cited by examiner

*Primary Examiner*—Teresa Walberg
*Assistant Examiner*—Thor Campbell

(74) *Attorney, Agent, or Firm*—A. W. Fisher, III

(57) ABSTRACT

A dual stage compressor for use with condensable fluids comprising a condensable fluid expansion stage in fluid and thermal communication with a condensable fluid compression stage wherein the condensable fluid expansion stage comprises a compressor head/heat exchange including a fluid expansion nozzle disposed in operative relationship relative to an condensable fluid expansion chamber formed therein and the condensable fluid compression stage comprises a reciprocating compression piston movable between a first and second position disposed within a compression cylinder having an intake port and an intake valve movable between a first and second position to selectively control fluid flow from the condensable fluid expansion chamber to the interior of the compression cylinder and an exhaust port and an exhaust valve movable between the first and second position to selectively control fluid flow from the compression cylinder such that when the reciprocating compression piston moves from the first to second position the intake valve moves from the first to second position to draw condensable fluids from the condensable fluid expansion chamber through the intake port into the interior of the compression cylinder and the exhaust valve moves from second position to the first position to close the exhaust port and when the compression piston moves from the second position to the first position the intake valve moves from the second to the first position to close the intake port and the exhaust valve moves from the first to second position to force condensable fluids from the interior of the compression cylinder through the exhaust port.

1 Claim, 2 Drawing Sheets

DUAL STAGE COMPRESSOR

CROSS REFERENCE

This is a continuation application for allowed application Ser. No. 09/519,651 filed Mar. 6, 2000 now U.S. Pat. No. 6,345,965 for Christopher L. Sagar entitled Dual Stage Compressor.

BACKGROUND OF THE INVENTION

1. Field of the Invention

The present invention relates to a dual stage condensable fluid compressor configured to use the expansion and compression of condensable fluids and thermal conductivity of the mechanical structure to operate at lower temperatures and higher efficiency that is generally associated with existing refrigerant compressors using oil lubricants.

2. Description of Prior Art

Numerous compressors have been developed for use with condensable fluids. However, inherent in many systems utilizing condensable fluids is the requirement that the condensable fluids be circulated under relatively high pressures and temperatures. As a result operative cooling of the compressor is often a limiting factor in the efficiency and life span of the compressor and related systems. Further, while mechanical compressors operate most efficiently with condensable fluids in vapor state, the use of condensable fluids in applications such as refrigeration inherently involve the change of state of the condensable fluid from gas to vapor to liquid. As a result, the design many systems utilize condensable fluids are compromised in terms of capacity and efficiency in order to ensure that fluid entering the compressor is in a vapor state. As will be described in greater detail, the present provides improved cooling and fluid delivery without the limitations of capacity and efficiency imposed by prior compressor designs. More particularly, the present invention utilizes a change of state of the condensable fluid within the compressor to provide both cooling and a vapor state of fluid entering the compression stage of the compressor.

SUMMARY OF THE INVENTION

The present invention relates to a dual stage condensable fluid compressor for use with condensable fluids such as refrigerants in air conditioning and refrigeration equipment. The dual stage condensable fluid compressor comprises a condensable fluid expansion stage in fluid and thermal communication with a condensable fluid compression stage.

The condensable fluid expansion stage comprises a fluid expansion nozzle to feed condensable fluids to an condensable fluid expansion chamber formed within a compressor head; while, the condensable fluid compression stage comprises a compressor cylinder having a reciprocating compression piston disposed therein. A reciprocating intake valve and an intake port are disposed between the condensable fluid expansion stage and the condensable fluid compression stage; while, a reciprocating exhaust valve and an exhaust port are disposed between the condensable liquid expansion stage and the condensable fluid compression stage.

In operation, the reciprocating compression piston reciprocates within the compressor cylinder. As reciprocating compression piston moves away from the compressor head, the intake valve moves from a closed position to a open position; while, the exhaust valve moves from an open position to a closed position thereby drawing condensable fluid into the expansion nozzle and expansion chamber and through the intake port into the compression cylinder. As the reciprocating compression piston moves towards the compressor head, the intake valve moves from an open position to a closed position; while, the exhaust valve moves from a closed position to an open position thereby forcing condensable fluid from the compression cylinder through the exhaust port.

During operation, heat is generated as a result of friction between the moving parts of the reciprocating compression piston and compression cylinder as well as by friction between the condensable fluid and the various internal surfaces of the condensable fluid expansion stage and the condensable fluid compression stage. As generated, heat is absorbed through these internal surfaces between the condensable fluid expansion stage and the condensable fluid stage by conduction. As condensable fluid enters the expansion chamber within the condensable fluid expansion chamber, a radiant and convective exchange of heat occurs between the condensable fluid and the interior surface of the expansion chamber.

Depending upon the initial temperature and state of the condensable fluid and the temperature of the expansion chamber, the condensable fluid may absorb or release heat to the surfaces of the expansion chamber. As a result, the condensable fluid enters the expansion chamber in the form of a liquid or gas, the condensable fluid undergoes a change of state to a vapor thereby providing for efficient performance of the condensable fluid compression stage.

The invention accordingly comprises the features of construction, combination of elements, and arrangement of parts which will be exemplified in the construction hereinafter set forth, and the scope of the invention will be indicated in the claims.

BRIEF DESCRIPTION OF THE DRAWINGS

For a fuller understanding of the nature and object of the invention, reference should be had to the following detailed description taken in connection with the accompanying drawings in which.

Similar reference characters refer to similar parts throughout the several views of the drawings.

DETAILED DESCRIPTION OF THE INVENTION

Figure 1:
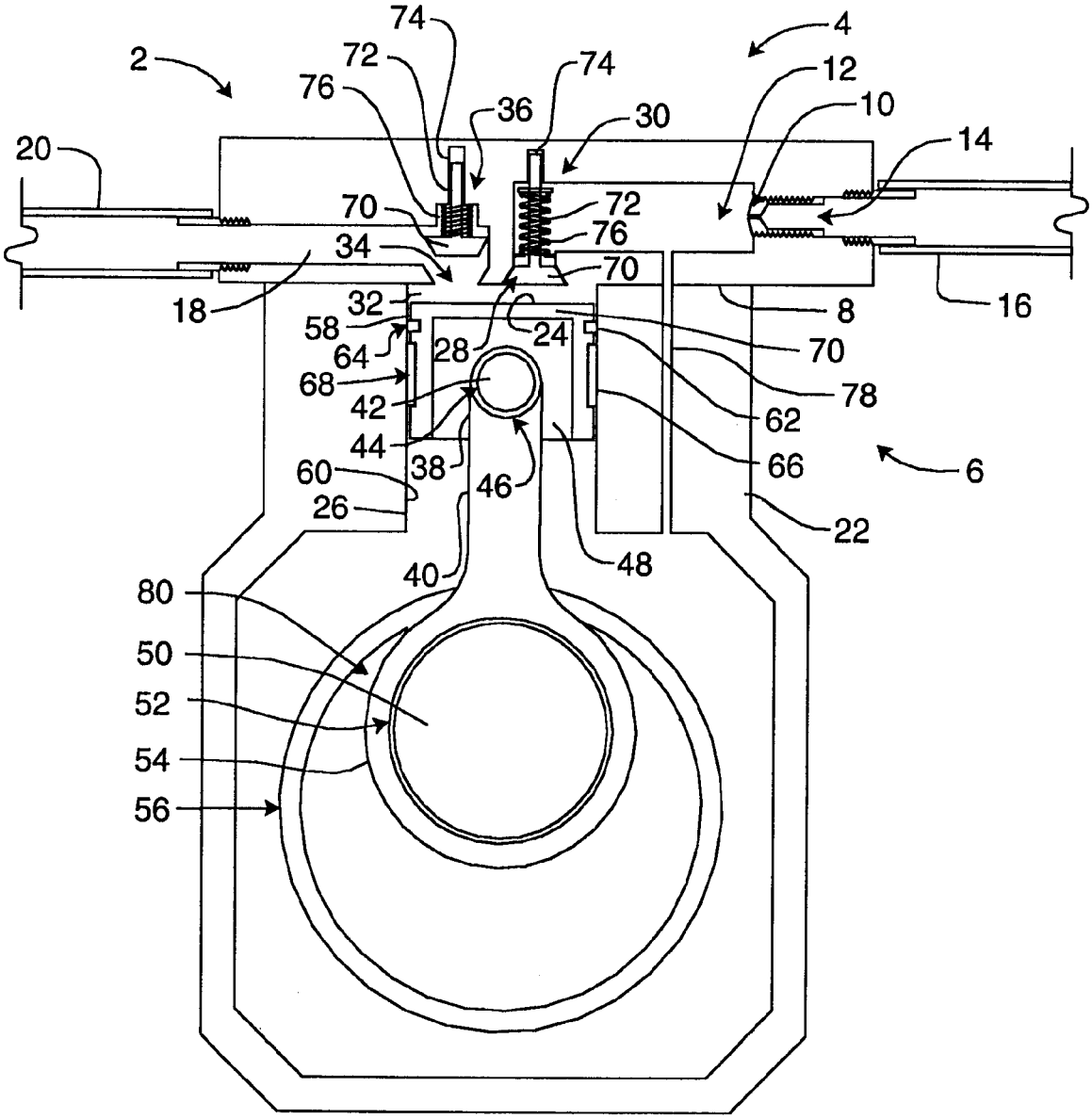
FIG. 1 is a cross-section front view of the dual stage condensable fluid compressor of the present invention with the reciprocating compression piston in the first position.
Figure 2:
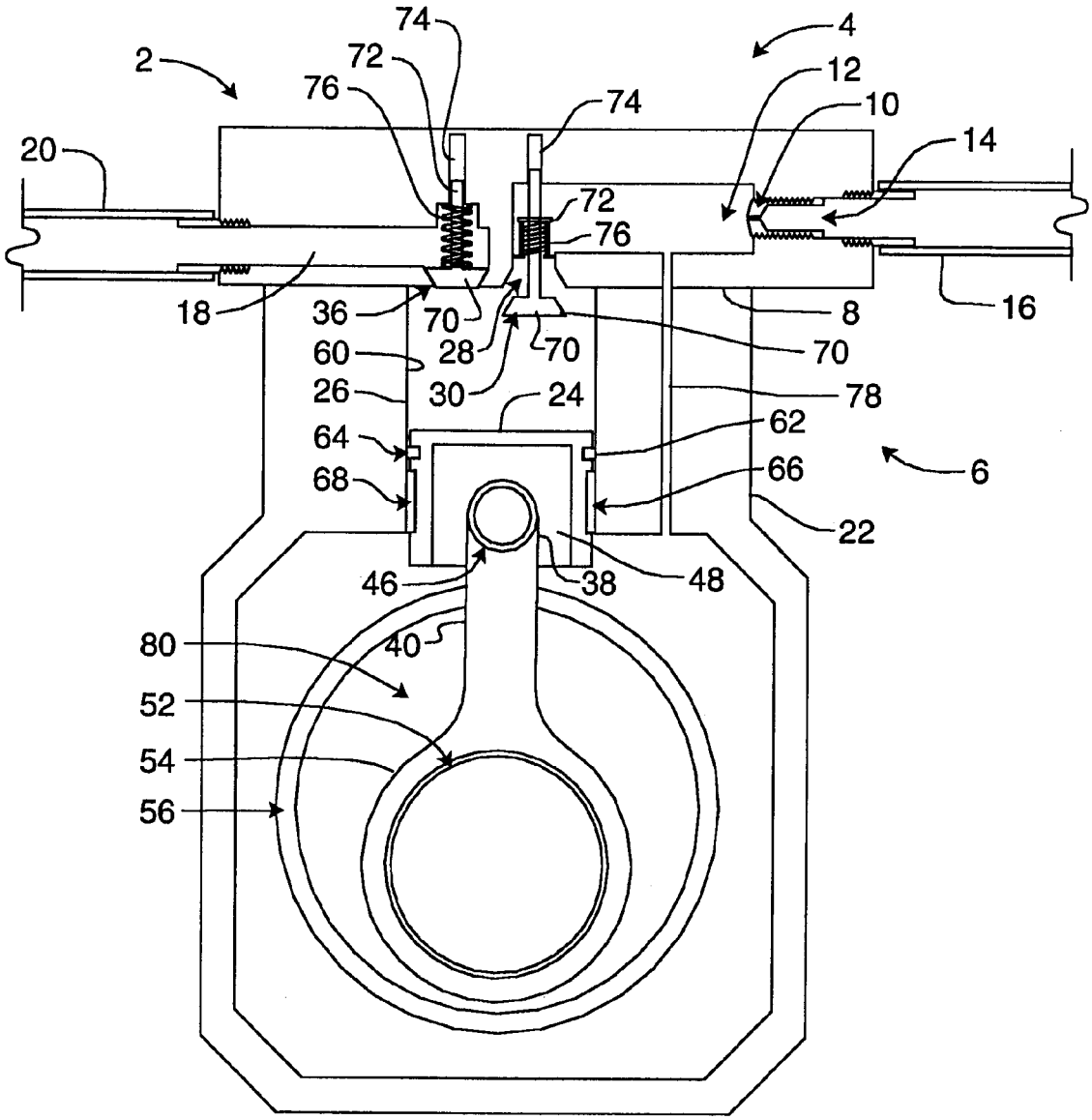
FIG. 2 is a cross-section front view of the dual stage condensable fluid compressor of the present invention with the reciprocating compression piston in the second position.

As shown in FIGS. 1 and 2, the present invention relates to a dual stage compressor generally indicated as 2 for use with condensable fluids such as refrigerants in air conditioning and refrigeration equipment. The dual stage condensable fluid compressor 2 comprises a condensable fluid expansion stage generally indicated as 4 and a condensable fluid compression stage generally indicated as 6 disposed in thermal conductive or heat transfer relationship relative to each other as described more fully hereinafter.

As shown in FIGS. 1 and 2, the condensable fluid expansion stage 4 comprises a compressor head/heat exchange 8 including a fluid expansion nozzle 10 disposed in operative relationship relative to an condensable fluid expansion chamber 12 formed therein. The condensable fluid expansion nozzle 10 is disposed in fluid communication relative to a condensable fluid supply chamber 14 formed in the compressor head/heat exchange 8 to selectively receive refrigerant through a condensable fluid supply conduit 16. The compressor head/heat transfer 8 further includes a condensable fluid exhaust chamber 18 and a condensable fluid exhaust conduit 20 to receive condensable fluids from the condensable fluid compression stage 6 as described more fully hereinafter.

As shown in FIGS. 1 and 2, the condensable fluid compression stage 6 comprises a compression housing 22 having a reciprocating compression piston 24 movable between a first and second position disposed within a compression cylinder 26 formed with the upper portion of the compression housing 22 having an intake port 28 and an intake valve generally indicated as 30 movable between a first and second position to selectively control fluid flow from the condensable fluid expansion chamber 12 to the interior 32 of the compression cylinder 26 and an exhaust port 34 and an exhaust valve generally indicated as 36 movable between the first and second position to selectively control fluid flow from the compression cylinder 26 to the condensable fluid exhaust chamber 18. The reciprocating compression piston 24 is coupled to the proximal end portion 38 of a connecting member 40 by a connecting pin 42 received by an opening 44 formed in the distal end 38 of the connecting member 40 and by a pair of side openings each indicated as 46 formed in the sidewall 48 of the reciprocating compression piston 24. The connecting member 40 is operatively coupled to a drive shaft 50 through a shaft opening 52 formed in the distal end portion 54 of the connecting member 40 disposed within a drive chamber 52 formed in the lower portion of the compression housing 22 such that rotation of the drive shaft 50 translates into reciprocating linear motion of the reciprocating compression piston 24 within the compressor cylinder 26.

To reduce friction and wear between the side wall 58 of the reciprocating compression piston 24 and the inner surface 60 of the compressor cylinder 26, a slide ring 68 is received by a first race 66 formed in the side wall 58 of the piston 24. The slide ring 68 is formed from resilient self lubricating materials such as teflon and serves as the main mechanical contact between the side wall 58 of the compression piston 24 and the inner surface 60 of the compressor cylinder 26. In order to provide a sealed fluid connection between the side wall 58 of the reciprocating compression piston 24 and the inner surface 60 of the compressor cylinder 26, a sealing ring 62 is formed around the reciprocating compression piston 24 received by a second race 64 formed in the side wall 58 of the reciprocating compression piston 24.

As shown in FIGS. 1 and 2, the reciprocating intake valve 30 and the reciprocating exhaust valve 36 each includes a disk shaped valve body 70 formed on one end of a elongated cylindrical guide stem 72 received by a channel 74 formed in the compressor head 8. A bias or positioning spring 76 is disposed in each channel 74 in operative relationship relative to the corresponding reciprocating valve 30 and 36 to facilitate closure of the corresponding reciprocating valve 30 and 36. It should be appreciated however, that both the reciprocating intake valve 30 and the reciprocating exhaust valve 36 can be replaced with a variety of other valve designs common in the art or even eliminated in favor of static intake and exhaust ports common in two pumps without altering the scope of the subject invention.

As further shown in FIGS. 1 and 2, a pressure relief duct 78 is formed in fluid communication with the expansion chamber 12 and the drive chamber 52 on the opposite side of the reciprocating compression piston 24 from the compressor head 8. At the commencement of operation, the pressure relief duct provides for an initial equalization of pressure in either side of the reciprocating compression piston 24 in order to reduce the torque required to initiate rotation of the drive shaft 50. The cross section area of the pressure relief duct 78 is sufficiently small to prevent a significant flow of fluid during sustained operation.

In operation, the drive shaft 50 is operatively coupled to a motor (not shown) to move the reciprocating compression piston 24 between the first position as shown in FIG. 1 and the second position as shown in FIG. 2. As the reciprocating compression piston 24 moves away from the compressor head 8 from the first to second position, a vacuum is created within the compressor cylinder 26. As this occurs, condensable fluid entering the intake port 28 from the expansion chamber 12 exerts pressure against the reciprocating intake valve 30 moving the reciprocating intake valve 30 downward into the compressor cylinder 26 causing condensable fluid to flow from the expansion chamber 12 through the intake port 28 into the interior 32 of the compressor cylinder 26. Simultaneously, condensable fluid within the exhaust chamber 18 exerts pressure against the reciprocating exhaust valve 36 forcing the reciprocating exhaust valve 36 into the exhaust port 34 thereby closing the exhaust port 34.

As shown in FIG. 2, when the reciprocating compression piston 24 moves towards the compressor head 8, condensable fluid within the compressor cylinder 26 exerts force against the reciprocating intake valve 30 causing the to seat within the intake port 28 thereby preventing the flow of condensable fluid from the compression cylinder 26 to the expansion chamber 12. Simultaneously, condensable fluid within the compression cylinder 26 exerts force against the reciprocating exhaust valve 36 causing the reciprocating exhaust valve 36 to unseat from the exhaust port 34 opening the exhaust port 34 and allowing condensable fluid to flow from the compressor cylinder 26 through the exhaust port 34 in to the exhaust chamber 18. Condensable fluid entering the exhaust chamber 18 then flows from the compressor head 8 through the condensable fluid exhaust conduit 20.

During operation of the dual stage compressor 2, heat is generated by the friction between the mechanical moving parts, friction between the condensable fluid and the various internal surfaces of the condensable fluid expansion stage 4 and the condensable fluid compression stage 6, and as a result of the increase in the pressure of condensable fluid within the compressor cylinder 24. As heat is generated, heat is absorbed by both the condensable fluid as well as by the mechanical structures within the condensable fluid expansion stage 4 and the condensable compression stage 6 by the conductive exchange between mechanical structure of the compressor cylinder 26 and compressor head 8 and by a radiant and convective exchange with the condensable fluid compression stage.

Depending upon the initial temperature and state of the condensable fluid and the temperature of the expansion chamber 12, the condensable fluid may absorb or release heat to the surfaces of the expansion chamber 12. As a result, the condensable fluid enters the expansion chamber 12 in the form of a liquid or gas, the condensable fluid undergoes a change of state to a vapor thereby increasing the efficiency performance of the condensable fluid compression stage 6.

In terms of the thermal and fluid states refrigerant whether in a liquid state or vapor state will change to a sub-cooled gaseous state utilizing the heat generated from the compression cycle to use as the heat is removed from the compressor head 8. This gaseous mixture travels through condensable fluid expansion chamber 12 imparting a radiant cooling effect into the compressor head 8 which will thermally migrate throughout the mechanical structure including the compressor cylinder 26, compressor head 8 and the compression housing 22. This gaseous mixture fills the compressor cylinder 26 gaseous mixture consumes until reciprocating compression piston 24 has reach the bottom of the stroke. When the reciprocating compression piston 24 returns to the first position at top dead center, the compression cycle is complete with the gaseous mixture compressed into a superheated higher pressure gas and discharged as previously described.

It will thus be seen that the objects set forth above, and those made apparent from the foregoing description, are efficiently attained and since certain changes may be made in the above construction without departing from the scope of the invention, it is intended that all matters contained in the foregoing construction or shows in the accompanying drawings shall be interpreted as illustrative and not a limiting sense.

It is also understood that the following claims are intended to cover all the generic and specific features if the invention herein described, and all statements of the scope of the invention which, as a manner of language, might be said to fall therebetween. Now that the invention has been described.

What is claimed is:

1. A dual stage compressor for use with condensable fluids comprising a condensable fluid expansion stage in fluid and thermal communication with a condensable fluid compression stage wherein said condensable fluid expansion stage comprises a compressor head including a fluid expansion nozzle disposed in operative relationship relative to an condensable fluid expansion chamber formed therein and said condensable fluid compression stage comprises a reciprocating compression piston movable between a first and second position disposed within a compression cylinder having an intake port and an intake valve movable between a first and second position to selectively control fluid flow from said condensable fluid expansion chamber to the interior of said compression cylinder and an exhaust port and an exhaust valve movable between the first and second position to selectively control fluid flow from said compression cylinder such that when said reciprocating compression piston moves from the first to second position said intake valve moves from the first to second position to draw condensable fluids from said condensable fluid expansion chamber through said intake port into the interior of said compression cylinder and said exhaust valve moves from second position to the first position to close said exhaust port and when the compression piston moves from the second position to the first position said intake valve moves from the second to the first position to close said intake port and said exhaust valve moves from the first to second position to force condensable fluids from the interior of said compression cylinder through said exhaust port said condensable fluid expansion nozzle is disposed in fluid communication relative to a condensable fluid supply chamber formed in said compressor head to selectively receive refrigerant through a condensable fluid supply conduit and said condensable fluid exhaust chamber is disposed in fluid communication relative to a condensable fluid exhaust conduit to receive condensable fluids from said condensable fluid compression stage, said intake valve and said exhaust valve each comprising a disk shaped valve body formed on one end portion of a corresponding elongated guide stem at least partially disposed within a corresponding channel formed in said compression head.

* * * * *